US009315998B1

(12) United States Patent
Aral et al.

(10) Patent No.: US 9,315,998 B1
(45) Date of Patent: Apr. 19, 2016

(54) CABLE LOCK-OFF BLOCK FOR REPAIRING A PLURALITY OF POST-TENSIONED TENDONS

(75) Inventors: Ersin (Eric) Aral, North Palm Beach, FL (US); James Andrew Wilson, Jupiter, FL (US)

(73) Assignee: Aral Wilson LLC, Tequesta, FL (US)

( * ) Notice: Subject to any disclaimer, the term of this patent is extended or adjusted under 35 U.S.C. 154(b) by 22 days.

(21) Appl. No.: 12/945,877

(22) Filed: Feb. 14, 2011

(51) Int. Cl.
*E04C 5/08* (2006.01)
*E04C 5/12* (2006.01)
*E01D 19/16* (2006.01)

(52) U.S. Cl.
CPC ..... *E04C 5/122* (2013.01); *E01D 19/16* (2013.01)

(58) Field of Classification Search
CPC ..... E04C 5/122; E04C 5/12; E01D 19/16; Y10T 24/3907
USPC ..... 52/223.1–223.14, 689, 371, 373, 374.1; 403/371, 373, 374, 367, 374.2, 374.1; 405/259.1–259.6
See application file for complete search history.

(56) References Cited

U.S. PATENT DOCUMENTS

| | | | | |
|---|---|---|---|---|
| 3,263,384 | A * | 8/1966 | Middendorf | 52/223.13 |
| 4,023,242 | A * | 5/1977 | Caro Roqueta | 24/122.6 |
| 5,596,854 | A * | 1/1997 | Crigler | 52/223.13 |
| 6,234,709 | B1 * | 5/2001 | Sorkin | 403/374.1 |

* cited by examiner

*Primary Examiner* — Brian Glessner
*Assistant Examiner* — Gisele Ford
(74) *Attorney, Agent, or Firm* — Simpson & Simpson, PLLC

(57) ABSTRACT

A cable lock-off block for repairing a plurality of post-tensioned tendons including an anchor body having a front side with a recess, a flat back side, a first outer edge, a second outer edge, a third outer edge and a fourth outer edge connecting the front side and the back side, the first outer edge having an opening, at least one wedge-receiving hole arranged within the recess, at least one removable wedge arranged in the at least one wedge-receiving hole, a continuous slot arranged within the anchor body connecting the opening and the at least one wedge-receiving hole and having a width to accommodate the plurality of post-tensioned tendons under full tension and a member removably secured within the continuous slot and forming at least a portion of the at least one wedge-receiving hole.

18 Claims, 8 Drawing Sheets

(SECT. 4–4)

(SECT. 1–1)

(SECT. 2–2)

(SECT. 3–3)

(SECT. 4–4)

(Front Perspective View)

(Rear Perspective View)

(Wedge Plate)

CABLE LOCK-OFF BLOCK FOR REPAIRING A PLURALITY OF POST-TENSIONED TENDONS

TECHNICAL FIELD OF INVENTION

The present invention relates to repairs of post-tensioning systems. More particularly, the present invention relates to post-tensioning systems having temporary intermediate anchorages (called herein lock-off blocks) during their de-tensioning and repair operations.

BACKGROUND ART OF THE INVENTION

Concrete is one of the commonly used materials of our time for building structures. One of the most unique properties of structural concrete is that while being capable of carrying substantial compressive loads, it is unable to carry significant tensile loads. It becomes necessary, therefore, to add reinforcing steel-bars, wires or cables to concrete to increase its tensile carrying ability in a concrete structure. The basic types of reinforcement methods in concrete structures can be separated into two groups as: conventionally reinforced structures, and pre-stressed concrete structures.

In conventionally reinforced concrete structures, deformed steel bars, called reinforcing bars, are placed in tensional stress areas of the concrete members, thus allowing the steel to carry the tensile forces and the concrete to carry compressive forces.

In pre-stressed concrete structures, the method of pre-stressing can be defined as the application of a pre-determined force or moment to a structural member, in such a manner that the combined internal stresses in the member, resulting from this force or moment and from any anticipated condition of external loading, is being confined within specific limits. Pre-stressed concrete is the result of applying this principle to concrete structural members, and eliminating or materially reducing the tensile stresses in the concrete. In this type structure, the type of reinforcement methods again separates the type of structures into two basic groups: pre-tensioned structures, and post-tensioned structures.

In pre-tensioned structures, reinforcing rods, cables or strands of high tensile strength wires (called tendons) are first pre-stretched to a certain pre-determined amount, and then high-strength concrete is placed around the reinforcing rods to form the concrete member. Once the concrete has set, pre-tensioned rods are released to introduce a compressible force into the member while the concrete holds the steel reinforcement in a tight bond, preventing slippage and sagging. The tendons used in pre-tensioned construction must be relatively small in diameter, because the bond stress between the concrete and the tendon is relied upon to transfer the stress from the tendon to the concrete. Pre-tensioning is mostly performed within individual concrete members at their manufacturing plant.

In post-tensioned structures, reinforcing rods, cables or strands of high strength wires (called tendons) are draped loosely to a profile as determined by structural analysis, and high-strength concrete is placed around them. The tendons are usually encased in a flexible plastic protective hose (called sheath or duct) to prevent the tendon from bonding to the concrete during placement and curing of the concrete. The protective sheathing remains in the structure. After the concrete has reached its pre-determined strength, the tendons are then stretched by hydraulic jacks and are securely anchored into place by some type of device mostly at their end locations. These devices are referred to as end anchorages. The end anchorages, together with the special jacking and grouting equipment used in accomplishing the post-tensioning by one of the several methods, are referred as post-tensioning systems.

In some cases, the void between the tendon and the sheath is filled with grout. In this manner, the tendon becomes bonded to the concrete section and corrosion of the steel tendon is prevented. In some other cases, the tendon is coated with grease prior to placement into a protective sheathing. Tendons of this type are not pressure grouted after stressing. This type of post-tensioning is usually referred to as an un-bonded post tensioning system. Post-tensioning of tendons is generally performed at the construction site.

In some instances, the metal components of the post-tensioning systems may become exposed to external sources of chlorides in service, such as de-icing salts, brackish water, seawater, or spray from these sources. There have been corrosion problems with either type of pre- and post-tensioning systems. However, certain aspects of corrosion of un-bonded single strand tendons are unique, and the end effects of corrosion of un-bonded single strand tendons are, in several respects, different from those of bonded conventional reinforcing or other post-tensioning systems. Thus, the methods for evaluating and repairing corrosion of single strand tendons are also different in some respects. For example, since the tendons are largely isolated from the surrounding concrete, they may not be affected by deleterious materials such as chlorides and moisture in the concrete. However, they also are not completely protected by the surrounding concrete, and can corrode if water gains access to the inside of the sheathing or anchorage and the grease protection is inadequate. Measures taken to repair and protect the surrounding concrete may not repair or reduce deterioration of the pre-stressing steel where corrosion has been initiated. The tendons usually require separate evaluation and repair.

The use of un-bonded tendons became more common during the late 1950s and early 1960s as design standards and materials standards were established. Due to their advantage over conventional type structures (shorter construction time, additional living space gain by reducing slab thickness and savings in overall cost), the use of post-tensioning gained more popularity during the late 1960s and 1970s and became one of the common type structural systems for many applications. In addition to their use in various building structures, un-bonded post-tensioning systems were used in parking structures, slab-on-grade, and nuclear power structures. The earliest incidents of corrosion of un-bonded tendons began to surface during the 1970s, since the grease used at that time period did not provide proper protection for corrosion. In the early 1980s, the Post-Tensioning Institute (PTI) recognized the structural implications of corrosion and began to implement measures to increase the durability of un-bonded post-tensioning systems. In 1985, PTI published the first performance standards for un-bonded tendons and included standards for grease (corrosion-inhibiting hydrophobic grease). The 1989 edition of American Concrete Institute (ACI 318), "Building Code Requirements for Reinforced Concrete", made changes to include protection measures for the tendons and the quality of the concrete from the environmental conditions that would promote corrosion. Structures built prior to the adaptation of these new standards are presently experiencing corrosion problems and are in need of repair.

When a tendon has been inadvertently cut and has no tension, the tendon, along with its end anchorages, is usually replaced. The original anchors may be reused, but dislodging the old wedges is sometimes difficult and the anchors can be damaged in the process. It is usually advisable to replace the anchors with new ones since this provides the opportunity to improve the system's durability. Once free of its anchorage, strand extraction is normally not difficult. In some cases a jack can be used to pull the strand out, but this method, while reliable, is slow. Usually the loose tendon is pulled out by hand or with the assistance of a come-along or a vehicle. When a tendon is damaged, or when corrosion damage is known or believed to be localized, repairs are often made by replacement of a part of the tendon either between anchorages or on one side of the damage. If the un-damaged portions of the tendons are in good condition, the damaged section of tendon is cut away and a new piece of tendon is spliced onto the ends of the original tendon using splice couplers. The old anchors may be reused as long as the tensional force in the tendon is maintained, and if the existing wedges are not unlocked. If the tendon has been de-tensioned, then the wedges are always replaced.

In most cases, the tendon damage is localized and can be determined by investigation prior to repairs. Usually un-bonded tendons are damaged close to their end anchorages and the remaining portions of the tendons are still in good condition. In these cases, the tendons are temporarily anchored (locked-off) by installing temporary anchors at locations where the tendons are still in good condition; the damaged end of the tendons are then cut and removed. A new tendon is spliced to the end of each existing tendon and the existing anchor is replaced with a new one. In order to lock the tendons with their internal tensional force intact, the existing tendon is usually exposed through a small chipped hole, its sheathing is removed and a temporary-anchor with two sets of wedges is installed around the tendon. The tensional force at the damaged side of the tendon is then gradually released by chipping the concrete behind the existing end-anchor and by doing so, transferring the tensional force onto the new temporary-anchor. The entire operation herein is referred as "tendon lock-off". The tendon lock-off operation is usually simple and unproblematic where the existing tendons are separate from each other, at locations where they are near to their original anchors or located in a uniform fashion. In post-tension band-lines (where post tensioning tendons are bundled to go over column lines and provide support for transfer-directional uniformly placed tendons), it is common practice to bundle several tendons together for ease of construction. Usually, four tendons per flat-bundle is the maximum recommended for floor slab construction. This limitation is pursued for two reasons. First, apart from poor consolidation, there is an increased potential of delamination at high and low profile points, and second, there is an increased probability of blow-outs at locations of horizontal curvatures due to outer strands riding over the inner ones. Unfortunately, in common practice, this recommendation is not always followed and more than four tendons are bundled together in a flat fashion. The repair of these banded tendons becomes difficult due to insufficient space between the tendons; the repair operation requires a larger exposure area for the placement of temporary-anchors, and/or most of the time, and instead of de-tensioning and repairing a single damaged tendon, it requires replacement of entire banded tendons.

BRIEF SUMMARY OF THE INVENTION

The lock-off devices that are presently available in the market place are made for anchoring tendons one at a time. These single anchorages require ample space between tendons for installation and therefore they are not suitable for bundled up un-bonded tendons. For close proximity, they require large chipped holes so that the tendons can be separated and they can be installed in a staggered fashion behind each other, thus creating slippage and eccentric forces on anchors and tendons, and an unsafe condition for workers and the structure.

The present invention is a cable lock-off block for repairing a plurality of post-tensioned tendons including an anchor body having a front side with a recess, a flat back side, a first outer edge, a second outer edge, a third outer edge and a fourth outer edge connecting the front side and the back side, the first outer edge having an opening; at least one wedge-receiving hole arranged within the recess; at least one removable wedge arranged in the at least one wedge-receiving hole; a continuous slot arranged within the anchor body connecting the opening and the at least one wedge-receiving hole and having a width to accommodate the plurality of post-tensioned tendons under full tension; and, a member removably secured within the continuous slot and forming at least a portion of the at least one wedge-receiving hole. The present invention disclosed herein is capable of locking-off multiple tendons in a concentric fashion and a safe manner. The anchor-block is sized to reduce bearing force on the existing concrete surface that is usually chipped and left in rough shape. A sufficient bearing surface reduces any chance of slippage, and a concentrically placed wedge assembly eliminates eccentricity on tendons.

DETAILED DESCRIPTION OF THE INVENTION

The invention provides a safe and unique system for temporarily anchoring multiple numbers of tendons during their repair operations. The invention is described below in greater detail by referring to the accompanying drawings herein.

Figure 1:
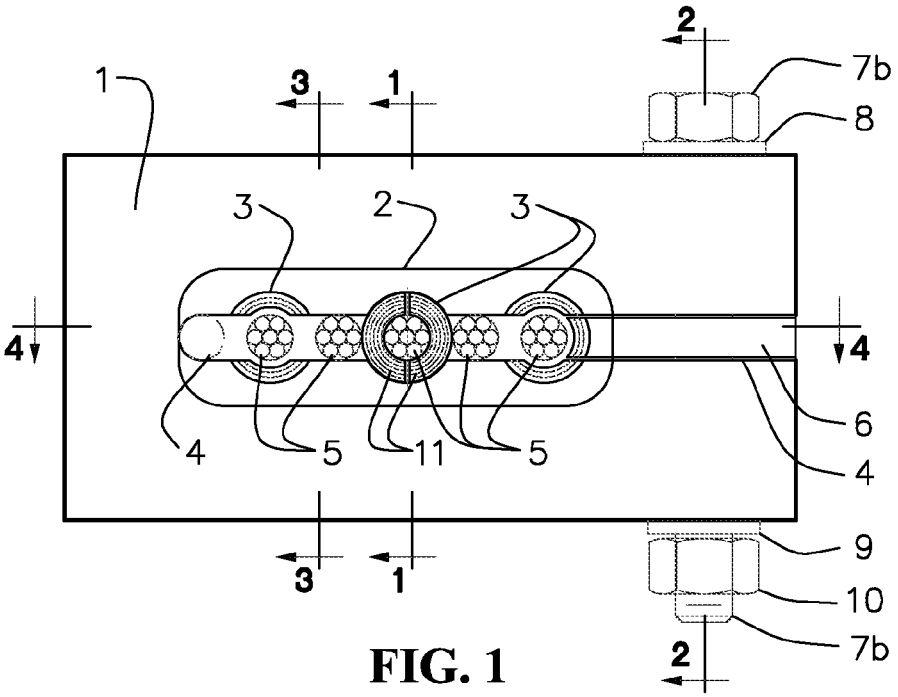
FIG. 1 illustrates a front view of the temporary anchor block having a flat surface with a recessed area in the middle of the anchor, multiple tapered holes and a continuous slot starting beyond the last tapered hole and extending through the multiple tapered holes to the outer edge of the anchor block. The continuous slot in the center of the anchor block provides an opening for the multiple tendons shown about the center of the anchor block. The end of the continuous opening is blocked with a wedge plate at the end of the continuous slot to retain the multiple post tensioning tendons in place during re-tensioning operations. The wedge plate is secured to the anchor block with a bolt.

FIG. 1 illustrates a front view of the lock-off block. The solid body of the lock-off block 1 consists of a recessed area 2 centered about the center of the block, a multiple number of tapered wedge-receiving holes 3 that are spaced one sheathed tendon diameter, a multiple number of tendons 5, a continuous full cut slot 4 (starting about one full-sheathed tendon diameter beyond the last tapered hole, continuing and connecting the tapered multiple holes, and extending to the outer edge of the lock-off block at the opposite end). The anchor body includes a wedge plate 6 that is a piece from the main body of the lock-off block, and cut from it during manufacturing to provide the continuous slot 4; the wedge plate matches the exact shape of the main anchor body cross section, including the inner surface of the tapered wedge-receiving hole. A bolt 7*b* is centered about mid depth of the anchor body and is placed perpendicular to the wedge plate (about the center of the wedge plate) with its washer 8, lock-washer 9 and nut 10. One pair of standard wedge 11 is shown in one of the tapered holes to illustrate how the tendons are locked-off during their temporary anchoring.

Figure 2:
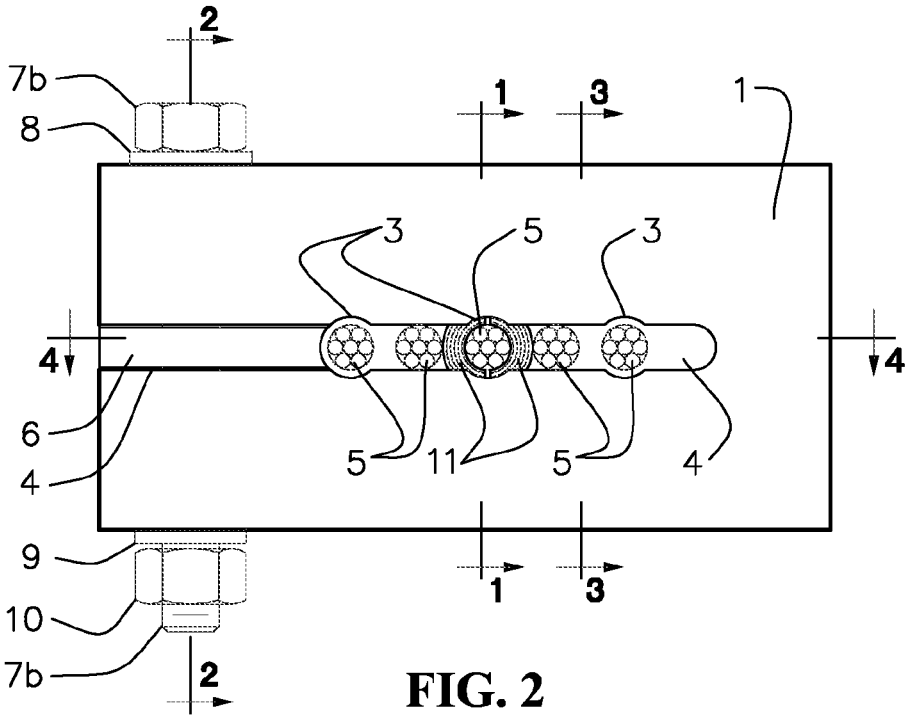
FIG. 2 illustrates a rear view of the temporary anchor block having a flat surface, multiple tapered holes and a continuous slot (starting beyond the last tapered hole and extending through the multiple tapered holes to the outer edge of the anchor block), a wedge plate with its bolt, and multiple tendons.

FIG. 2 illustrates the back view of the lock-off block. This view of the lock-off block 1 includes the smaller diameter side of the multiple-number tapered wedge-receiving holes, a multiple number of tendons 5, a continuous full-depth cut slot 4 (starting about one full sheathed tendon diameter beyond the last tapered hole, continuing and connecting the tapered multiple holes, and extending to the outer edge of the lock-off block at the opposite end), a wedge plate 6, a bolt 7*b* and its washer 8, lock-washer 9 and nut 10. The bottom side of one pair standard wedge 11 is shown in one of the tapered holes to illustrate how the tendons are locked off during temporary anchoring.

Figure 3:
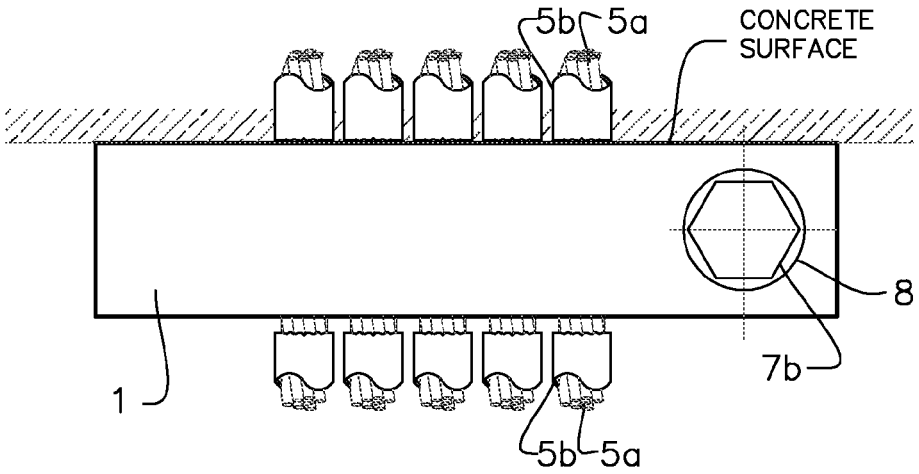
FIG. 3 illustrates a top view of the anchor block having a narrower flat surface with a bolt on one side of the anchor block. Note that "top view" is used herein for description only; anchors can be used in upside down position. The rear of the anchor is always positioned against a concrete surface and cannot be used for temporarily anchoring tendons.

FIG. 3 illustrates the top view of the lock-off block. This view of the lock-off block 1 includes a narrower rectangular flat top surface, a multiple numbers of tendons 5*a* with their sheathing 5*b*, and a bolt 7*b* with its washer 8. The sheathings of the tendons are cut and removed prior to placing them into the lock-off block (from the concrete surface to a sufficient location in front of the lock-off block).

Figure 4:
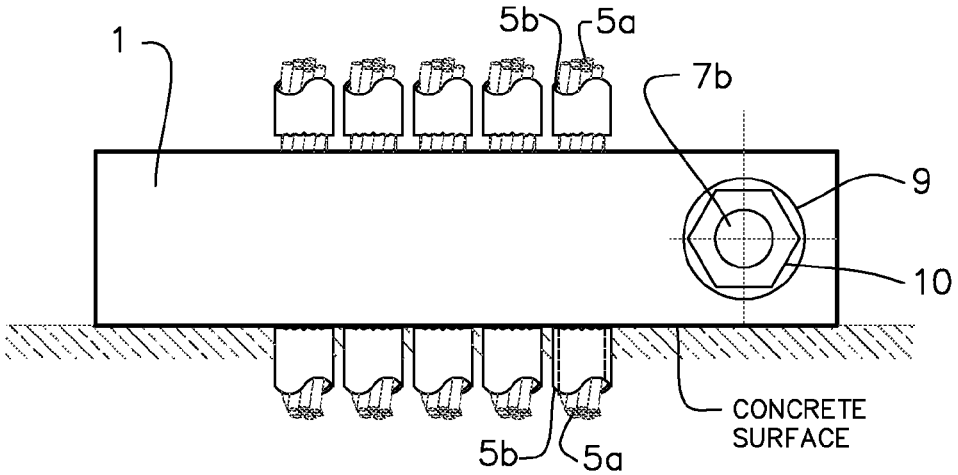
FIG. 4 illustrates a bottom view of the anchor block having a similar opposite hand view of FIG. 3.

FIG. 4 illustrates the bottom view of the lock-off block. This view of the lock-off block 1 includes a narrower rectangular flat bottom surface, a multiple numbers of tendons 5*a* with their partially removed sheathings 5*b*, and bolt 7*b* with its lock-washer 9, and nut 10.

Figure 5:
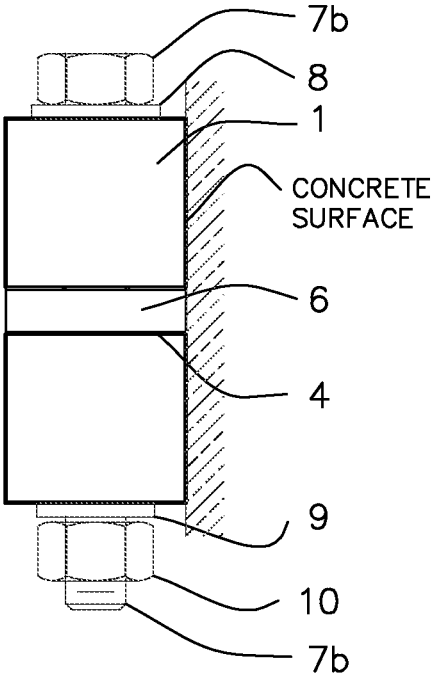
FIG. 5 illustrates a side view of the anchor where the horizontal continuous slot extends to the exterior face of the anchor. A wedge plate is located in the continuous slot and the wedge plate is secured to the anchor block with a bolt.

FIG. 5 illustrates a side view of the lock-off block where the horizontal continuous slot 4 extends to the exterior face of the lock-off block 1. A wedge plate 6 is located in the continuous slot and the wedge plate is secured to the lock-off block with a bolt 7*b*. The wedge plate 6 is centered about the mid height of the lock-off block 1, and the bolt 7*b* is centered about the mid depth of the lock-off block 1 and the wedge plate 6.

Figure 6:
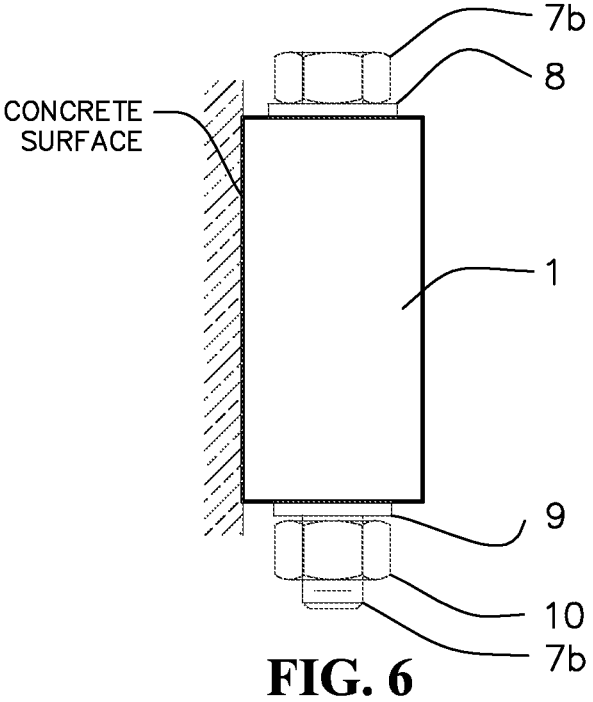
FIG. 6 illustrates a side view of the anchor opposite to the side shown on FIG. 5, having a solid continuous body of metal with no cuts or openings.

FIG. 6 illustrates a side view of the lock-off block opposite to the side where the lock-off block 1 is horizontally slotted (see FIG. 5). This side of the lock-off block 1 is shaped as one continuous solid body of steel and is sized to sustain the tensional force created by the multiple tendons.

Figure 7:
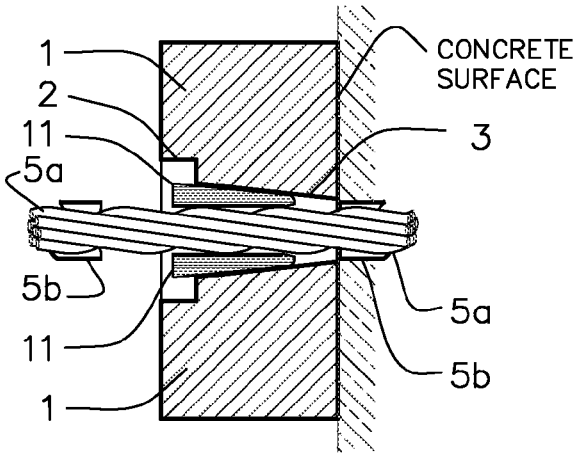
FIG. 7 illustrates a sectional view of the anchor (in a transverse direction) through one of the wedge-receiving tapered holes. The tapered hole is centered about the front recessed area and both the recess and the tapered hole are centered about the anchor block. A tendon and it's a wedge assembly are shown to illustrate how the tendon is temporarily anchored at the anchor block.

FIG. 7 illustrates Section 1-1 taken through one of the multiple tapered holes. This section of the lock-off block 1 includes a recessed front area 2, a tapered wedge-receiving hole 3, a tendon 5*a* through the tapered hole (sheathing 5*b* of the tendon 5*a* is removed prior to placement into the lock-off block), and one pair of standard wedges 11. The recess 2 is located at the center of the lock-off block and is indented a sufficient distance into the body of the lock-off block 1 to receive a second lock-off block over the first one without interference with the wedges 11 that are protruding out from the tapered holes. The larger side of the tapered wedge-receiving hole 3 is located at the base of the recess (starting as a 1 inch diameter hole and then tapering down to a smaller diameter hole at the back side of the lock-off block). The smaller diameter of the hole is slightly larger than one un-sheathed diameter of a tendon 5. The taper of the wedge-receiving hole 3 is constant for up to a 1.5 inch depth and the angle of taper is kept between 6 and 7 degrees so that standard size wedges can be utilized. The lock-off block depth is in direct relation with the number of tendons to be anchored. The cross-sectional area of the lock-off block 1 at each side of the tapered hole 3 is sized (with an applicable safety factor per American Institute of Steel Construction, 13$^{th}$ Edition) to bear the tensional force generated by the multiple tendons 5*a* in the tapered holes.

Figure 8:
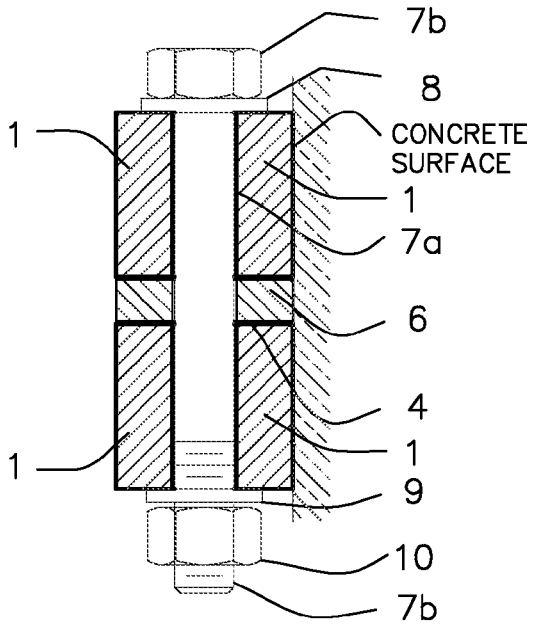
FIG. 8 illustrates a sectional view of the anchor (in a transverse direction) about the face of the bolt that is located at the end of the continuous slot. The bolt (shown in full assembly with its washers and nut) is centered about the anchor body and the wedge plate. The wedge plate (shown in cross section) is located in the continuous slot about the mid height of the anchor body.

FIG. 8 illustrates Section 2-2 taken parallel to the bolt hole 7*a*, about the center of the bolt 7*b*. This section of the lock-off block 1 includes a wedge plate 6, a continuous slot 4 about the middle of the lock-off block, a through bolt-hole 7*a* (from top of the lock-off block to the bottom), a bolt 7*b* with its washer 8, lock-washer 9 and nut 10. The wedge plate 6 is placed into the continuous slot 4 and secured to the lock-off block body 1 with a bolt 7*b*. The lock-off block 1 and the bolt 7*b* are sized for the tensional force generated by the multiple tendons 5*a* in the tapered holes.

Figure 9:
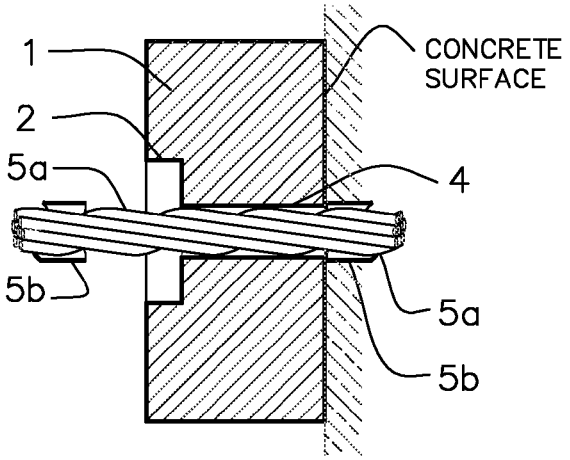
FIG. 9 illustrates a sectional view of the anchor (in a transverse direction) through the mid continuous slot between the tapered holes. The continuous slot is centered about the front recessed area and both the recess and the slot are centered about the anchor body. A tendon is shown to illustrate how the continuous hole provides a passage for tendons that are not going to be locked-off to the anchor block.

FIG. 9 illustrates Section 3-3 taken through one of the connecting slots 4 between the tapered wedge-receiving holes 3. The section of the lock-off block body 1 includes a recessed front area 2, and a rectangular shaped slot 4 with a width that is slightly larger than one diameter of an un-sheathed tendon, and a tendon 5*a* through the slot (sheathing 5*b* of the tendon 5*a* is removed prior to placement into the lock-off block).

Figure 10:
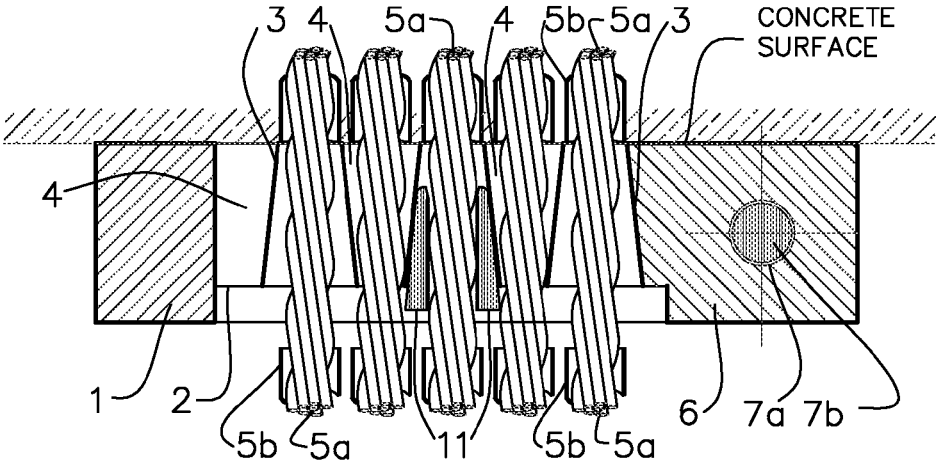
FIG. 10 illustrates a sectional view of the anchor (in a longitudinal direction) about the center of the continuous slot and multiple tapered holes, having a recessed area in front, multiple wedge-receiving tapered holes, a continuous slot (starting beyond the last tapered hole and extending through the multiple tapered holes to the outer edge of the anchor body). The continuous opening in the center of the anchor block provides a passage for the multiple tendons shown about the center of the anchor body. A wedge plate in the shape of the anchor body cross-section is located at the end of the continuous hole to retain the multiple tendons in place. The wedge plate is secured to the anchor block with a bolt. A pair of wedges is shown in one of the tapered holes to illustrate how the tendon is temporarily anchored to the anchor body.

FIG. 10 illustrates Section 4-4 taken horizontally about center of the wedge-receiving holes and continuous slot. This section of the lock-off block 1 includes a recessed front area 2, multiple wedge-receiving holes 3, a continuous slot 4 (starting about one full sheathed tendon diameter beyond the last tapered hole, continuing between the tapered multiple holes, and extending to the outer edge of the lock-off block at the opposite end), multiple numbers of tendons 5*a* (sheathings 5*b* of the tendons 5*a* are removed prior to placement into the lock-off block), a wedge-plate 6, a bolt-hole 7*a* and a bolt 7*b*. In addition, one pair of standard wedges 11 is shown in one of the tapered holes to illustrate how the tendons are locked off during temporary anchoring. The maximum number of tendons for the invention lock-off block is equal to the total number of tapered and slotted holes minus one.

Figure 11:
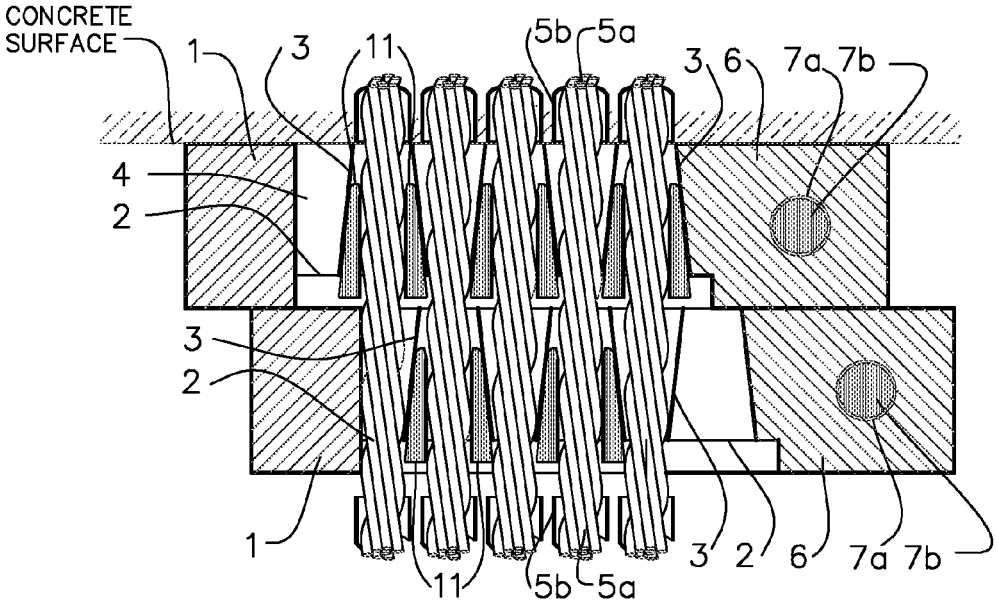
FIG. 11 illustrates a sectional view of the two temporary anchor (lock-off) blocks assembled one in front of the other to provide a temporary anchorage system for multiple tendons. All of the tendons are located in the tapered holes of the first lock-off block (the lock-off-block against the concrete surface) and are locked off by placing a pair of wedges at each side of the tendon. The remaining tendons that are not locked off at the first lock-off block are locked off at the second lock-off block.
Figure 12:
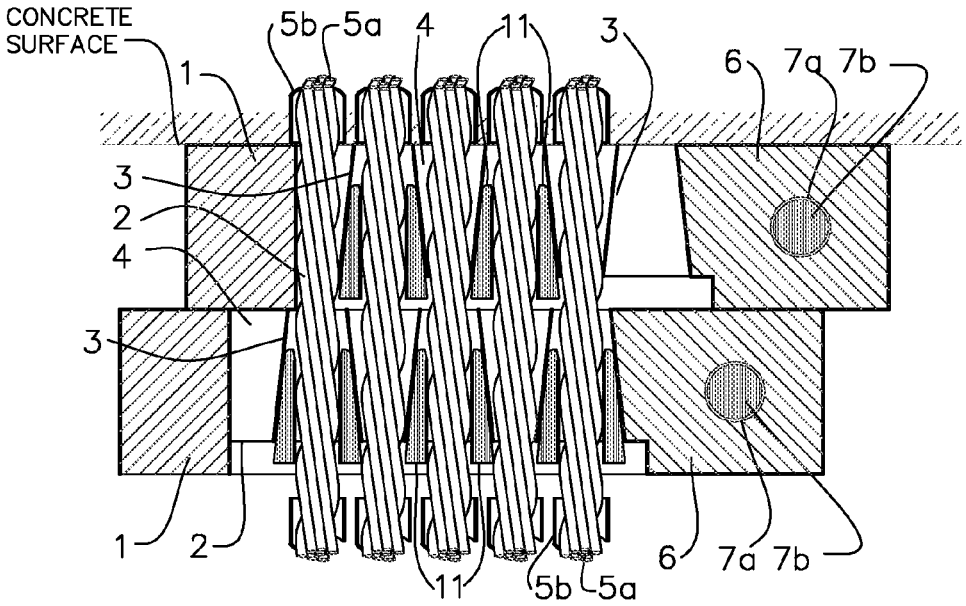
FIG. 12 illustrates a sectional view of two temporary lock-off blocks assembled one in front of the other to provide a temporary anchorage system for multiple tendons similar to FIG. 11. Some of the tendons are located in the tapered holes of the first lock-off block (the anchor against the concrete surface) and are locked-off by placing a pair of wedges at each side of the tendon. The tendons that are not locked-off at the first lock-off block are locked-off at the second anchor.

FIG. 11 and FIG. 12 illustrate the temporary anchorage of a multiple-tendon post-tensioning band-line utilizing two invention lock-off blocks. The horizontal cross-section of each lock-off block 1 is similar to FIG. 10. In FIG. 11, all tendons in tapered holes 3 are anchored (locked-off) in the first lock-off block, and the remaining anchors located in the connecting slots are locked off in the second lock-off block that is placed directly behind the first anchor. In FIG. 12, one of the tapered holes is not used, leaving one extra tendon to go through the first lock-off block without anchorage. Again, all remaining tendons in the connecting slots are locked off in the second lock-off block. Note that in each case the lock-off blocks are offset one un-sheathed tendon diameter so that the tendons in connecting slots are lined up with the tapered holes of the second lock-off block.

Figure 13:
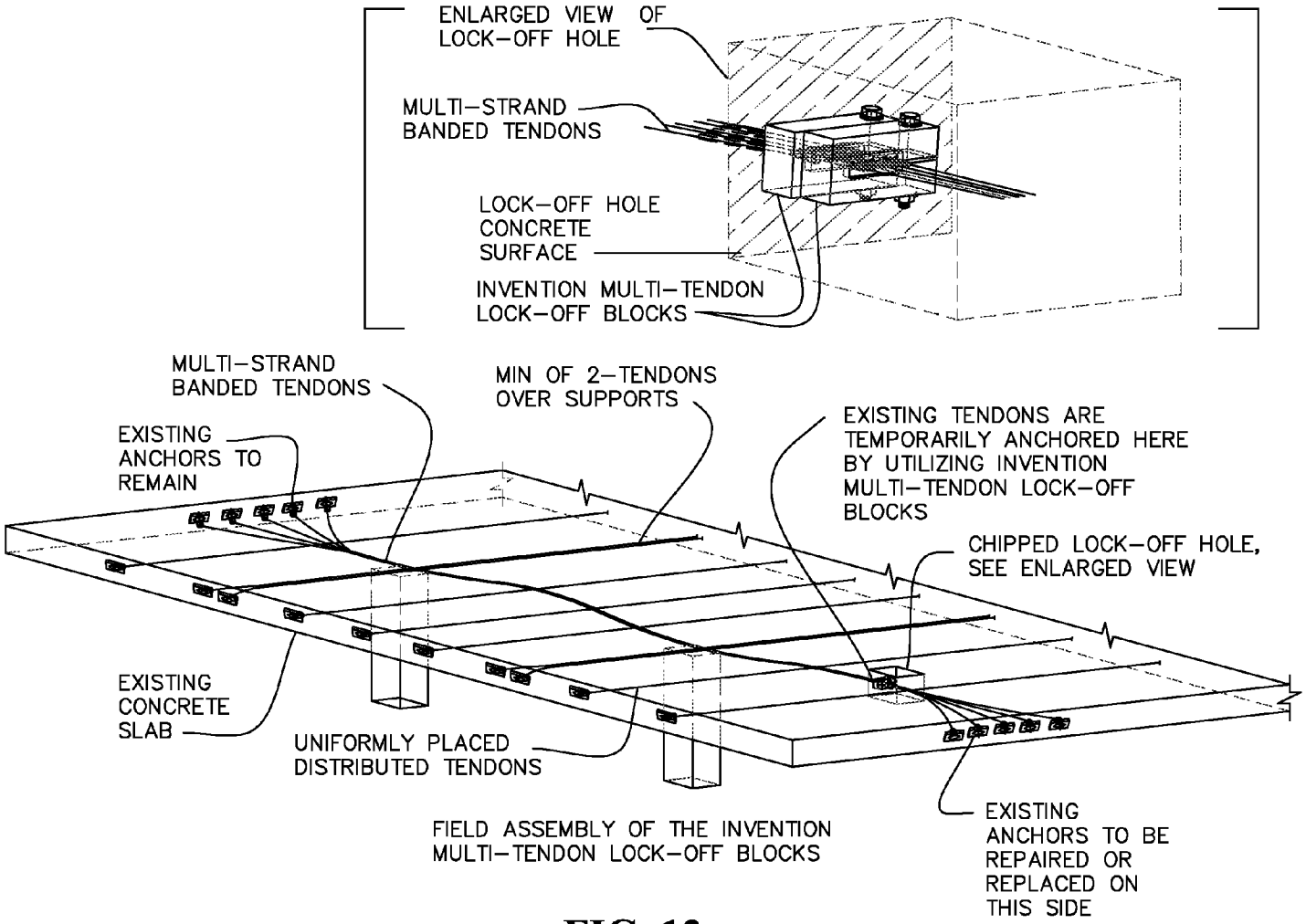
FIG. 13 illustrates a perspective view of a structural slab where multiple tendons will be repaired. The section shows a multi-tendon band-line with its end anchorages and the invention temporary-anchor system that is field-assembled in a chipped opening to lock off a multiple tendon band-line.

FIG. 13 illustrates the field assembly of the invention lock-off block assembled for multiple-tendon post tensioning band-line repairs. The tendons along the band-lines are usually bundled together along the column lines, but are separated close to their end anchorages. If some of the existing anchors and part of the tendons close to the end anchorage of the band-line are damaged, but the remaining portion of the existing tendons are in good condition, then in order to reduce the repair cost and time, the existing tendons are usually locked-off in chipped holes and then the damaged anchors and end portion of the damaged tendons are replaced. This type of repair procedure reduces the areas to be shored during repairs (in general, de-tensioned tendon areas in front of the locked-off tendons are shored) and reduces the repair cost drastically. If the tendon damage extends to a bundled tendon location, the absence of any locking devices for bundled multiline tendons, necessitate de-tensioning of the entire banded tendons for repairs, thus dictating shoring along the band lines.

Figure 14:
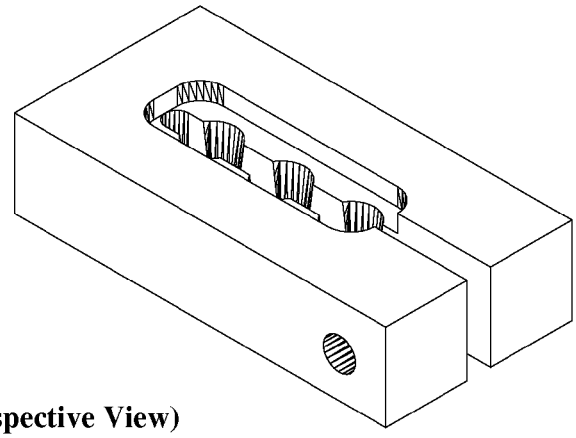
FIG. 14 and FIG. 15 illustrate perspective views of the front and the rear faces of lock-off block respectively.
Figure 15:
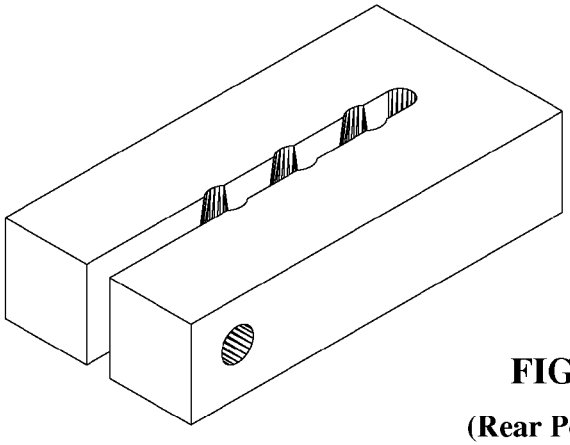
Figure 16:
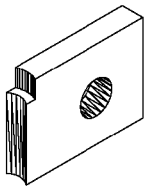
FIG. 16 illustrates a perspective view of the wedge plate.

FIGS. 14 & 15 illustrate perspective views of the front and rear sides of an un-assembled lock-off block (wedge plate and the bolt are removed). The un-assembled lock-off block is placed around the tendons that are to be locked-off and then the wedge plate and the bolt are assembled while the tendons are in the cavity of the anchor body. FIG. 16 illustrates a perspective view of an un-assembled wedge plate. The inner face of the wedge plate is recessed and tapered to match the inner face of the first tapered hole The load-bearing area of the lock-off block is in direct relation with the number of tendons to be temporarily anchored. Based on the total number of tendons, a certain amount of bearing area is provided per American Concrete Institute, Building Code Requirements for Structural Concrete (ACI 318-05) so that the existing concrete surface is not overstressed due to compression force exerted onto it. The compression force that is produced by the tensile force from temporarily anchored tendons is concentrated at the load-bearing area (rear face) of the lock-off block. This force is then gradually distributed to the concrete at some distance from the lock-off block and some of this force includes some component that is transverse to the axis of the tendons. If the load-bearing area of the lock-off block is too small, then the transverse forces may cause internal tension in the concrete that is greater than the tensile strength of the concrete. Another reason for providing an adequate bearing surface is insufficient reinforcement in concrete where the lock-off openings are chipped for the installation of lock-off blocks. The thickness of the lock-off block is based on the number of tendons to be anchored, and the strength of the material used for fabrication. In order to reduce the cost of production, the lock-off block is shaped and dimensioned so that a readily available strength material can be used for fabrication. For multiple numbers of tendons that are in excess of five tendons, the thickness needs to be increased more than the thickness indicated in this application.

It is to be clearly understood that any or all of the forgoing aspects of a lock-off block made according to the invention are applicable to any number of tendons in a post-tension band-line and are not limited to the numbers shown on drawings provided herein. In addition, the invention temporary anchoring system may also be used in repairs of other multi-tendon retaining systems such applications as barrier-cables, bridge girders, etc.

Although the invention has been described with respect to a limited number of embodiments, various changes in the details of the illustrated construction may be made within the scope of appended claims without departing from the scope of invention. The embodiments shown herein are merely illustrative of the inventive concepts and should not be interpreted as limiting the scope of the invention.

The invention broadly comprises an intermediate temporary anchor block (called herein lock-off block) used with post-tensioned cables, which has the ability to retain and anchor multiple post-tensioning cables (banded tendons that are laid side by side in a flat bundled fashion and are under full tension) during their repair operations. The apparatus is formed as a U-shaped solid body of block with front and back flat surfaces and a continuous opening in the middle consisting of equally-spaced multiple-tapered, wedge-receiving circular holes (spaced at one sheathed tendon diameter and located longitudinally at the center of the block) internally connected to form a passageway with a continuous slot to one side of the block. The continuous slot is parallel and centered about the circular openings and is rectangular in shape; the slot starts close to one side of the anchor block with a width slightly larger than one un-sheathed tendon diameter, and extends through the tapered circular openings to the outer edge of the other side of the block, and allows the tendons that are under tension to be placed into the body of the lock-off block. A bolt hole is provided at the entry side of the lock-off block, and is used with a bolt and a wedge-plate to contain the tendons in their original position during detensioning/locking-off operations. The wedge-receiving holes are tapered and the front face of the block is recessed. The tendons that are lined up with the tapered openings are locked off during detensioning by placing wedges between the tendon and the lock-off block's tapered interior surface. The recess in the front face allows the multiple lock-off blocks to be used in sequence (one in front of the other) without interfering with the wedges of the previous lock-off block, and allows multiple numbers of cables (tendons) to be locked off in succession.

What is claimed is:

1. A cable lock-off block for repairing a plurality of post-tensioned tendons, comprising:

an anchor body having a front side with a recess, a flat back side, a first outer edge, a second outer edge, a third outer edge and a fourth outer edge connecting the front side and the back side, the first outer edge having an opening;

at least one wedge-receiving hole arranged within the recess;

at least one removable wedge arranged in the at least one wedge-receiving hole;

a continuous slot arranged within the anchor body connecting the opening and the at least one wedge-receiving hole and having a width to accommodate the plurality of post-tensioned tendons under full tension; and, a member removably secured within the continuous slot and forming at least a portion of the at least one wedge-receiving hole.

2. The cable lock-off block as recited in claim 1, said recess being located at a center of the anchor body and longitudinally dimensioned to receive the at least one wedge-receiving hole.

3. The cable lock-off block as recited in claim 1, wherein the at least one wedge is disposed at least partially in the recess.

4. The cable lock-off block as recited in claim 1, wherein the at least one wedge-receiving hole includes a tapered interior surface with a taper angle.

5. The cable lock-off block as recited in claim 4, wherein the taper angle is between 6 and 7 degrees.

6. The cable lock-off block as recited in claim 1, wherein said at least one wedge-receiving hole is spaced one sheathed diameter of a tendon from another wedge-receiving hole.

7. The cable lock-off block as recited in claim 1, wherein the continuous slot is rectangular and the width is arranged to accommodate the plurality of post-tensioned tendons when the plurality of post-tensioned tendons are partially sheathed.

8. The cable lock-off block as recited in claim 1, wherein the continuous slot includes:

a first end which is closed and disposed a first distance from the at least one wedge-receiving hole; and, a second end which is open and disposed within the opening of the first outer edge.

9. The cable lock-off block as recited in claim 8, wherein the member is a wedge plate arranged proximate the second end of the continuous slot.

10. The cable lock-off block as recited in claim 1, wherein the wedge-receiving hole and the continuous slot are transversally centered about a center of the anchor block.

11. The cable lock-off block as recited in claim 1, wherein the member fits and fills the continuous slot between the at least one wedge-receiving hole and the first outer edge of the anchor body.

12. The cable lock-off block as recited in claim 1, wherein the at least a portion of the member is tapered.

13. The cable lock-off block as recited in claim 1, wherein the recess is centered transversally about a center of the anchor body and offset longitudinally to accommodate a bolt hole and a bolt placed perpendicular to the continuous slot hole.

14. The cable lock-off block as recited in claim 13, wherein the bolt is operatively arranged to accommodate a total accumulated shear force applied by the plurality of post-tensioned tendons.

15. The cable lock-off block as recited in claim 1, wherein the anchor body about is operatively arranged to accommodate one half of a total accumulated tension force applied by the plurality of post-tensioned tendons.

16. The cable lock-off block as recited in claim 1, wherein the anchor body is operatively arranged to accommodate one half of a total accumulated shear force applied by the plurality of post-tensioned tendons.

17. The cable lock-off block as recited in claim 1, wherein the plurality of post-tensioned tendons are arranged to be locked off by a means for de-tensioning the plurality of post-tensioned tendons from a wedged-end side.

18. The cable lock-off block as recited in claim 8, wherein a second distance between the first end of the continuous slot and the at least a portion of the member is equal to a length of a maximum number of unsheathed banded-tendons accommodated therein plus one unsheathed tendon.

* * * * *